US006854155B2

(12) United States Patent
Herndon

(10) Patent No.: US 6,854,155 B2
(45) Date of Patent: Feb. 15, 2005

(54) LOBBY DUSTPAN

(76) Inventor: George W. Herndon, 806 N. Dawson St., Thomasville, GA (US) 31792

( * ) Notice: Subject to any disclaimer, the term of this patent is extended or adjusted under 35 U.S.C. 154(b) by 0 days.

(21) Appl. No.: 10/271,903

(22) Filed: Oct. 15, 2002

(65) Prior Publication Data

US 2003/0088938 A1 May 15, 2003

Related U.S. Application Data

(60) Provisional application No. 60/329,100, filed on Oct. 15, 2001.

(51) Int. Cl.[7] ..... A47L 13/52

(52) U.S. Cl. ..... 15/257.7

(58) Field of Search ..... 15/257.1–257.7, 15/104.8; 294/1.4, 53.5; 403/326, 329, 119, 52, 65, 66

(56) References Cited

U.S. PATENT DOCUMENTS

| | | | | | |
|---|---|---|---|---|---|
| 210,953 | A | | 12/1878 | McCarthy | |
| 301,479 | A | | 7/1884 | Clark | |
| 497,401 | A | * | 5/1893 | Bates | 15/257.7 |
| 531,177 | A | | 12/1894 | Gere | |
| 802,634 | A | * | 10/1905 | Greer | 15/257.7 |
| 829,522 | A | * | 8/1906 | Green | 15/257.4 |
| 900,705 | A | * | 10/1908 | Chapman | 15/257.7 |
| 959,926 | A | * | 5/1910 | Feld et al. | 15/257.7 |
| 1,203,697 | A | | 11/1916 | Bump | |
| 2,621,958 | A | * | 12/1952 | Miller | 294/53.5 |
| 2,750,613 | A | | 6/1956 | Trindi | |
| 2,849,743 | A | * | 9/1958 | McFarland | 15/257.2 |
| 2,864,107 | A | | 12/1958 | Greenleaf | |
| 2,978,731 | A | | 4/1961 | Belluomini | |
| 3,971,095 | A | | 7/1976 | Fish, Sr. | |
| 4,005,892 | A | * | 2/1977 | Williams | 294/1.4 |
| 5,343,589 | A | | 9/1994 | Davenport | |
| 5,483,720 | A | | 1/1996 | Decoopman et al. | |
| 5,894,096 | A | * | 4/1999 | Kotraba et al. | 73/864.63 |
| 5,979,004 | A | | 11/1999 | Wilson | |
| 6,023,812 | A | | 2/2000 | Morad | |
| 6,196,600 | B1 | * | 3/2001 | Miller | 294/1.4 |
| 6,282,745 | B1 | | 9/2001 | Alt | |
| 6,370,725 | B1 | | 4/2002 | Carlson | |

FOREIGN PATENT DOCUMENTS

| | | | | |
|---|---|---|---|---|
| FR | 767096 | * | 4/1934 | 15/257.4 |
| FR | 1332021 | * | 6/1963 | 15/257.4 |
| GB | 18118 | * | 8/1912 | 15/257.7 |

* cited by examiner

*Primary Examiner*—Gary K. Graham
(74) *Attorney, Agent, or Firm*—Brian D. Bellamy

(57) ABSTRACT

The lobby dustpan of the invention includes a receptacle that is pivotally connected to a bail and includes an elongate handle connected to the bail. A receptacle-connecting member is situated on the top wall rearward of the bail for pivotal connection of an elongate manipulating rod to the receptacle. A gripping member retained in relation to the elongate handle for lineal movement and connected to the elongate manipulating rod enables manipulation of the receptacle the between a resting position and a disposal position.

2 Claims, 3 Drawing Sheets

LOBBY DUSTPAN

PRIORITY CLAIM

The present application claims benefit of the priority filing date of U.S. Provisional Application Ser. No. 60/329,100 filed on Oct. 15, 2001.

BACKGROUND OF THE INVENTION

1. Field of the Invention

The present invention relates generally to a new and useful improvement in lobby dustpans for use in removing litter that is swept from floor surfaces. More particularly, the present invention relates to a lobby dustpan having a tray control mechanism for manipulating the dust containing tray portion of the dustpan for collection and convenient disposal of rubbish.

2. Description of the Prior Art

Although dustpans with a tray controlling features have been disclosed in the art, to wit: U.S. Pat. Nos. 301,479 and 959,926, it has long been felt that the amount of movement and labor necessary to accomplish the emptying of a dustpan hindered the usefulness of these pans and decreased productivity, especially in commercial settings. Further, it has long been felt to the tray portion of the dustpan is difficult to manipulate during emptying because of its position and distance from the operator with respect to the main handle of the apparatus.

U.S. Pat. No. 301,479 discloses a dust box having a small handle for raising the rear of the box. While the small handle operates to place the dust box in a position for emptying its contents. The handle is situated near the tray portion of the dustpan and requires the operator to bend and place his hand near the tray for operating.

Thus, a continuing need exists for a dustpan having a remotely controlled tray for convenient emptying of the tray's contents.

As will be seen, the present invention achieves its intended purposes, objectives and advantages by accomplishing the needs as identified above, through a new, useful and unobvious combination of component elements, which is simple to use, with the utilization of a minimum number of functioning parts, at a reasonable cost to manufacture, assemble, test and by employing only readily available material.

SUMMARY OF THE INVENTION

Accordingly, it is an object of the present invention to provide a lobby dustpan that will overcome the deficiencies, shortcomings, and drawbacks of prior lobby dustpans.

It is another object of this invention to provide a remotely controlled tray on the lobby dustpan.

Another object of this invention to provide a tray manipulating mechanism to provide remote control of the lobby dustpan tray.

The foregoing outlines some of the more pertinent objects of the invention. These objects should be construed to be merely illustrative. Other beneficial results can be obtained by applying the disclosed invention. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
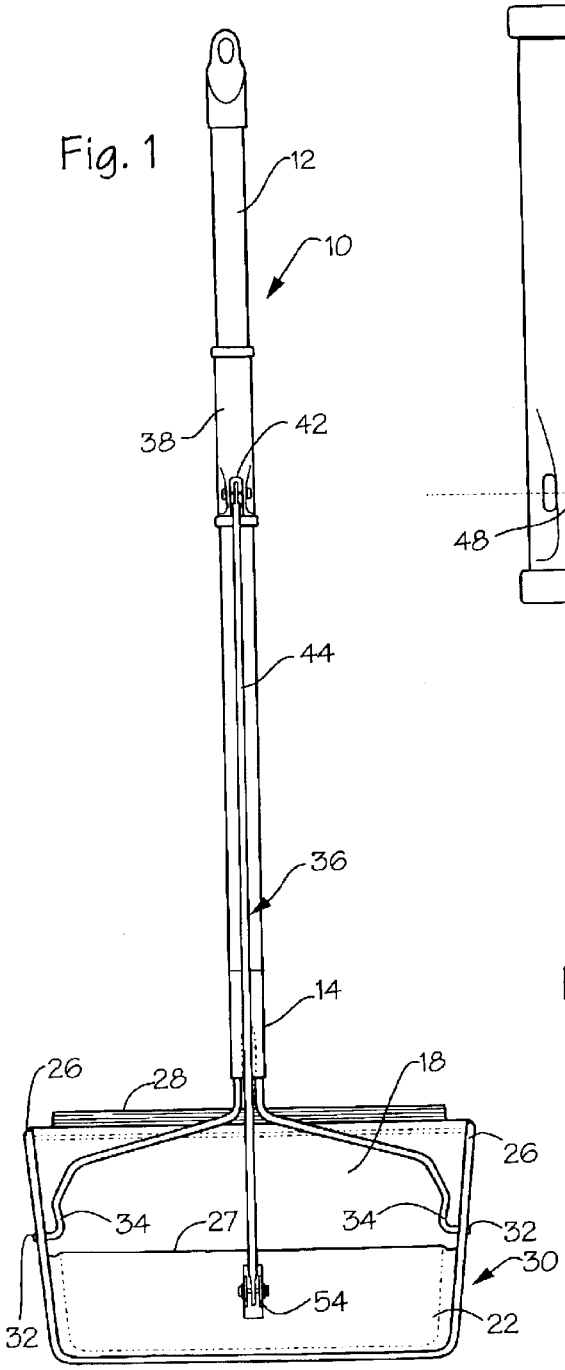
FIG. 1 is a front plan view of a lobby dustpan constructed in accordance with the teachings of the invention and illustrating the tray manipulating mechanism with the dustpan lifted and in a folded retracted position.
Figure 2:
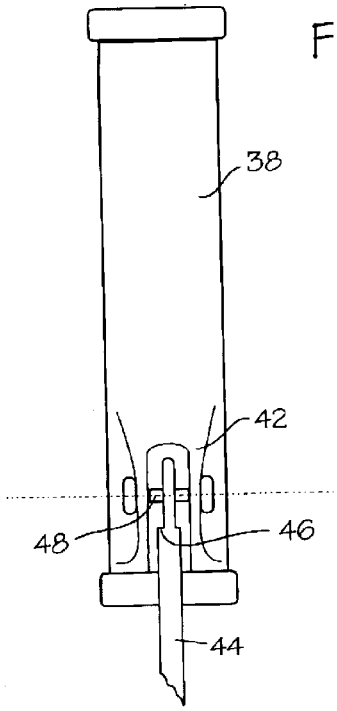
FIG. 2 is an enlarged sectional front plan view of the collar of the present invention and connection of the manipulating rod to the collar.

With reference to the drawings, in particular to FIGS. 1–8 thereof, the present invention, an improved lobby dustpan denoted by reference numeral 10, will be described. A lobby dustpan 10 is shown comprising an elongate handle 12 connected to by a handle-receiving portion 14 to a bail 16. The bail is pivotally connected to a receptacle portion 18 or tray via conventional attaching means such that the tray is permitted to rotate about a horizontal axis of the receptacle portion. The receptacle portion 18 of the lobby dustpan is well-known in the art, and typically includes a bottom wall 20, a top wall 22, a generally flat and rectangular rear wall 24 and a pair of spaced apart side walls 26 closed at one end by the rear wall. The bottom wall 20 and top wall 22 being spaced apart and extending generally transversely from the rear wall 24. The side walls 26 extending transversely from the rear wall 24. Each side wall is coupled with the top wall 22 and bottom wall 20 to form a continuous front edge 27 of all the walls which defines an aperture 29 into the receptacle 18. The open ends of the side walls 26 generally have a lip 28 extending between them.

Figure 6:
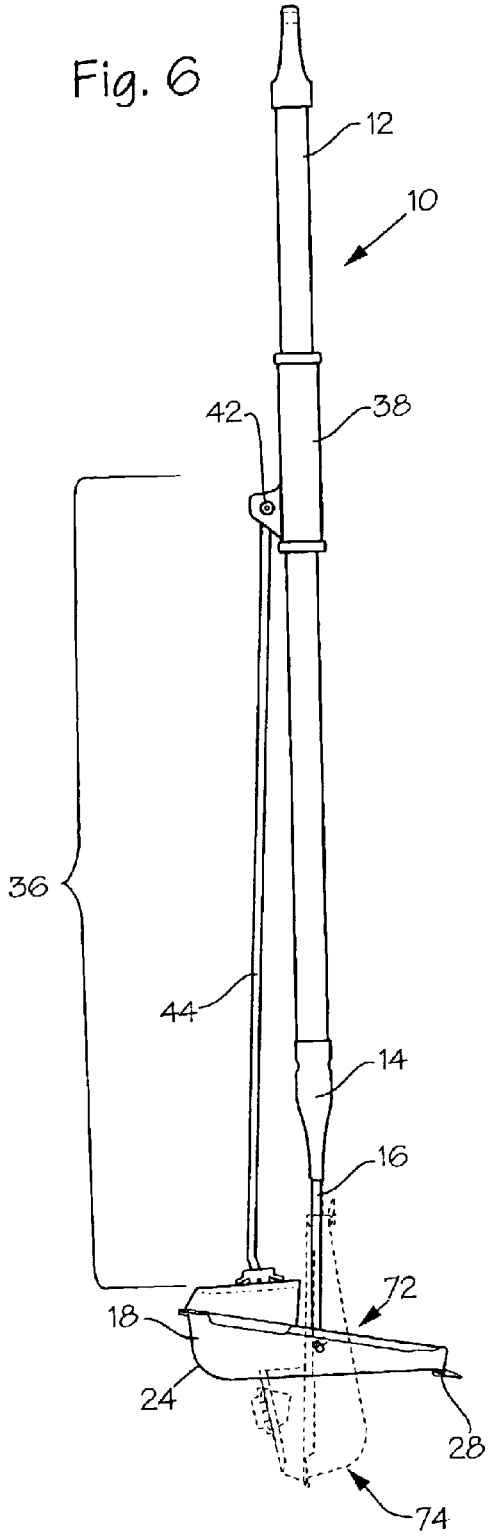
FIG. 6 is a side plan view of the present invention depicting the tray in the horizontal position for emptying or placement on a floor surface.
Figure 8:
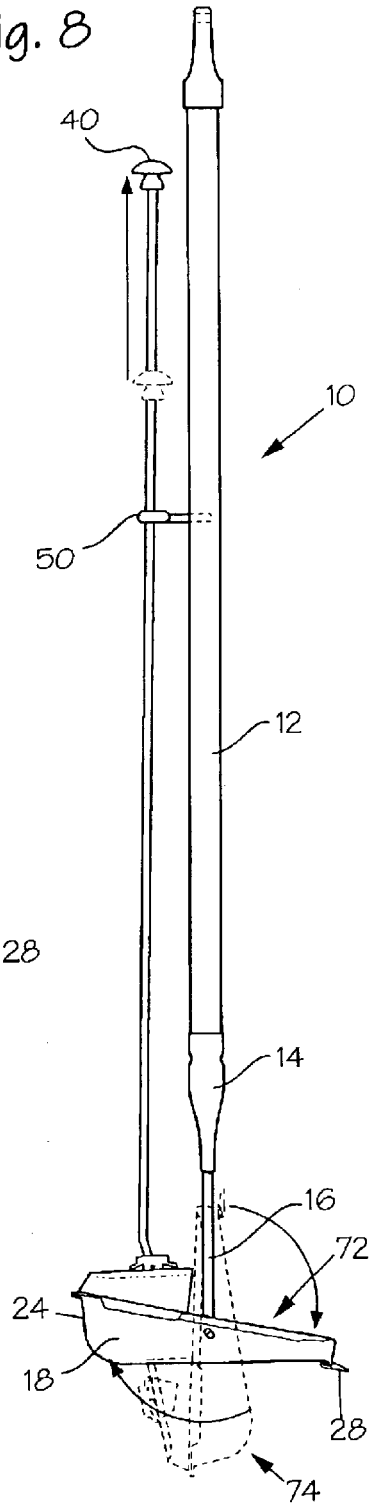
FIG. 8 is an alternative embodiment of the present invention.

The receptacle portion 18 of the lobby dustpan 10 is shown in transit or resting position in FIG. 1. The active position of the dustpan is shown in FIGS. 6 and 8. The receptacle 18 is mounted to the elongate handle 12 by rotary or pivotal hinge means generally designated by the numeral 30. Such pivotal hinge means includes a pair of axially aligned connecting openings 32 provided in the side walls 26 of the receptacle 18. In the embodiment illustrated a pair of mounting members 34 form part of the bail 16 and extend into the connecting openings 32.

The lobby dustpan 10 further includes several improvements that improve manipulation of the receptacle portion 18. As shown in FIG. 1, the dustpan includes a tray manipulating mechanism generally designated as 36. In FIG. 1, the tray manipulating mechanism includes a hand-operated collar 38 in moving relation to the elongate handle 12. An alternative embodiment is shown in FIG. 8 depicting the arrangement of a similarly functioning gripping member or ring 40 in moving relation to the elongate handle 12. In FIG. 1, a handle-connecting bracket 42 is provided on the collar 38 for connection of a manipulating rod 44. The rod includes a first end member 46 for pivotal connection of the rod via a pivot pin 48 that is inserted through the handle-connecting bracket 42. The collar 38 retains the manipulating rod in such that the rod is allowed to move lengthwise in parallel relation to the elongate handle. In FIG. 8, the manipulating rod 44 is retained by an eyelet 50, which is affixed to the elongate handle 12. While the eyelet retains the manipulating rod, the manipulating rod is allowed to move lengthwise in parallel relation to the elongate handle by gripping the ring, knob or gripping member 40.

Figure 3:
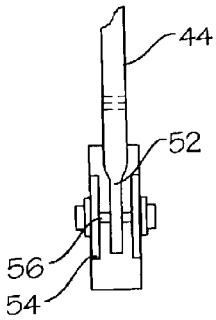
FIG. 3 is an enlarged sectional front plan view of the tray connecting bracket of the present invention and connection of the manipulating rod to the tray connecting bracket.
Figure 4:
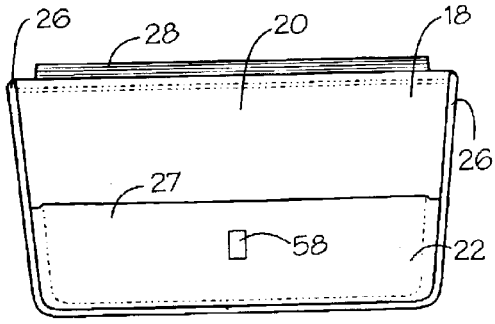
FIG. 4 is a top plan view of the tray of the lobby dustpan of the invention.
Figure 5:
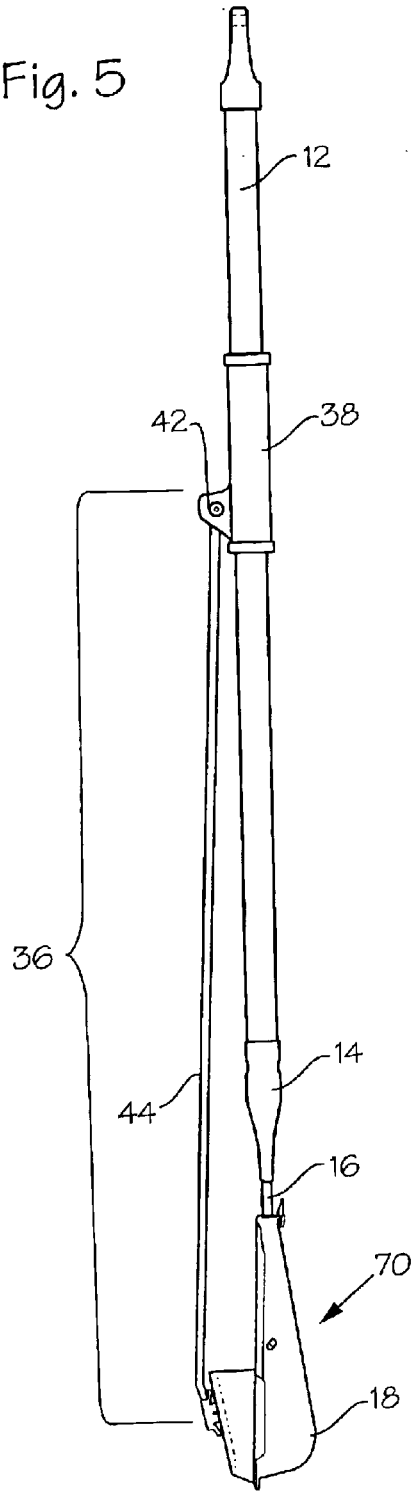
FIG. 5 is a side plan view of the present invention depicting the tray in the upright position.
Figure 7A:
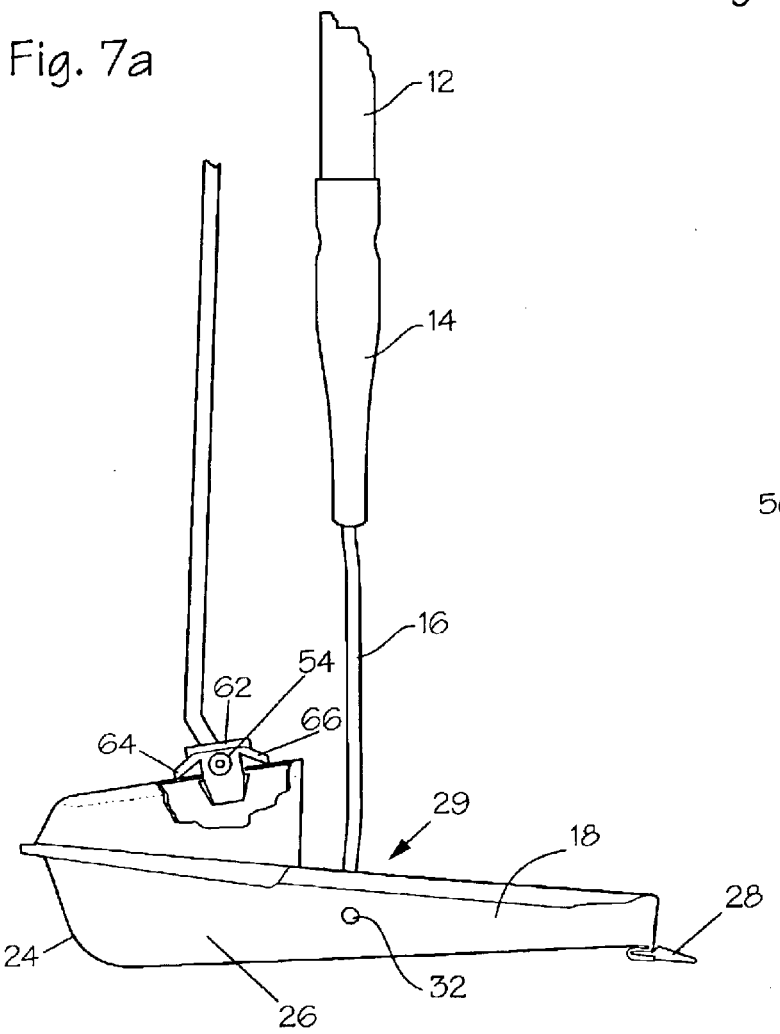
FIG. 7*a* is an enlarged sectional side plan view of the lower portion of the invention showing the configuration of the manipulating rod to the tray connecting bracket while the tray is in the horizontal position.
Figure 7B:
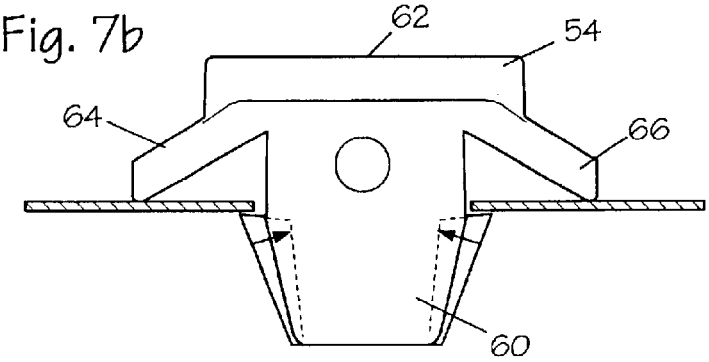
FIG. 7*b* is a further enlarged side plan view of one embodiment of the tray connecting bracket of the invention.

The manipulating rod 44 attaches near the center of the top wall 22 of the receptacle 18 as shown in FIGS. 1 and 3. The rod 44 may include a second end member 52 for pivotal connection of the rod to a receptacle-connecting bracket 54 via a pivot pin 56 that is inserted through the receptacle-connecting bracket. The receptacle-connecting bracket 54 shown in FIGS. 7*a* and 7*b* is replaceable and configured for smooth operation while manipulating the receptacle 18. The replaceable receptacle-connecting bracket 54 includes a wedge-shaped extension 60 that is inserted into aperture 58, such that the top wall 22 of the receptacle 18 retains the bracket 54. The bracket 54 further includes a top surface having a flat central portion 62, a first angular portion 64 angled rearward and downward with respect to the top wall 22 of the receptacle 18 and a second angular portion 66 angled forward and downward with respect to the top wall 22 as shown in more detail in FIG. 7*b*. The manipulating rod 44 includes a forward bend 68 adjacent to the second end member 52. The combination of the forward bend 68 and uniquely configured receptacle-connecting bracket 54 permit smooth manipulation of the receptacle 18 through a full range of motion from an at rest position 70 as shown in FIG. 5, to an active position 72 as shown in FIGS. 6 and 8 to a rubbish disposal position 74 as shown by the dashed lines in FIGS. 6 and 8.

As best seen in FIGS. 6 and 8, when the receptacle 18 is placed on a surface to be cleaned, it will assume a horizontal active position 72. The elongate handle 12 and manipulating rod 44 are shown in an upright position. Slight downward pressure may be imposed on the elongate handle 12 and upward movement may be imposed on the manipulating rod 44 by collar 38 or gripping device 40 to assume the horizontal active position 72. Upward movement of the manipulating rod 44 will impart upward force on the rearward portion of the receptacle 18 causing the forward portion of the receptacle to move downward, which can assist in causing the lip 28 to be flush with the surface being cleaned.

As best seen in FIGS. 6 and 8 by the dashed lines, when the receptacle 18 is lifted and the manipulating rod 44 moved upward, the receptacle 18 will assume a vertical position with the open end between the side walls 26 oriented downward to the rubbish disposal position 74 for emptying the contents of the receptacle. Thus, upward pressure is applied by hand to the collar 38 or gripping device 40 to move the manipulating rod 44 upward and cause the dumping of rubbish from the receptacle 18.

While the present invention has been particularly shown and described with reference to an embodiment thereof, it will be understood by those skilled in the art that various changes in form and detail may be made without departing from the spirit and scope of the present invention.

I claim:

1. A lobby dustpan comprising:

a receptacle which includes a generally flat, rectangular rear wall, a bottom wall extending transversely from the rear wall, a top wall extending transversely, in the same direction as the bottom wall, from the rear wall to a height greater than the bottom waLl, said top and bottom walls being spaced apart, and a pair of side walls extending transversely from the rear wall, in the same direction as said bottom wall, each side wall being coupled with the top and bottom walls to form a continuous front edge of all the walls which defines an aperture into said receptacle;

a bail pivotally connected to the side walls;

an elongate handle connected to the bail;

a receptacle-connecting member situated on the top wall rearward of the bail, the receptacle-connecting member having a wedge-shaped extension that is inserted into an aperture on the top wall and having a flat upper surface defined by an upper surface of a central portion having an aperture, a first angular portion providing a surface on the receptacle-connecting member angled rearward and downward with respect to the top wall, and a second angular portion providing a surface on the receptacle-connecting member angled forward and downward with respect to the top wall;

an elongate manipulating rod pivotally connected at a first end to the aperture of the receptacle-connecting member; and a gripping member retained in relation to the elongate handle for lineal movement and connected to a second end of the elongate manipulating rod, said receptacle being pivotal on said bail by said gripping member into between a resting position and a disposal position.

2. A lobby dustpan comprising:

a receptacle which includes a generally flat, rectangular rear wall, a bottom wall extending transversely from the rear wall, a top wall extending transversely, in the same direction as the bottom wall, from the rear wall to a height greater than the bottom wall, said top and bottom walls being spaced apart, and a pair of side walls extending transversely from the rear wall, in the same direction as said bottom wall, each side wall being coupled with the top and bottom walls to form a continuous front edge of all the walls which defines an aperture into said receptacle;

a bail pivotally connected to the side walls;

an elongate handle connected to the bail;

a receptacle-connecting member situated on the top wall rearward of the bail, the receptacle-connecting member having a flat upper surface defined by an upper surface of a central portion having an aperture, a first angular portion providing a surface on the receptacle-connecting member angled rearward and downward with respect to the top wall, and a second angular portion providing a surface on the receptacle-connecting member angled forward and downward with respect to the top wall;

an elongate manipulating rod pivotally connected at a first end to the receptacle-connecting member, the rod having a forward bend adjacent to the first end of the rod that bends toward the aperture of the central portion of the receptacle-connecting member; and a gripping member retained in relation to the elongate handle for lineal movement and connected to a second end of the elongate manipulating rod, said receptacle being pivotal on said bail by said gripping member into between a resting position and a disposal position.

* * * * *